US005857924A

United States Patent [19]

Miyagawa et al.

[11] Patent Number: 5,857,924

[45] Date of Patent: Jan. 12, 1999

[54] GOLF BALL

[75] Inventors: Naoyuki Miyagawa; Masataka Kai; Toshio Chikaraishi, all of Chichibu, Japan

[73] Assignee: Bridgestone Sports Co., Ltd., Tokyo, Japan

[21] Appl. No.: 840,758

[22] Filed: Apr. 16, 1997

[30] Foreign Application Priority Data

Apr. 19, 1996 [JP] Japan ..... 8-122539

[51] Int. Cl.[6] ..... A63B 37/12; A63B 37/14

[52] U.S. Cl. ..... 473/365; 473/377; 473/384

[58] Field of Search ..... 473/383, 385, 473/364, 377

[56] References Cited

U.S. PATENT DOCUMENTS 4,681,323 7/1987 Alaki et al. ..... 473/384

5,497,996 3/1996 Cadorniga ..... 473/383 X 5,702,312 12/1997 Horiuchi et al. ..... 473/377

*Primary Examiner*—George J. Marlo

*Attorney, Agent, or Firm*—Sughrue, Mion, Zinn, Macpeak & Seas, PLLC

[57] ABSTRACT

A golf ball has a multiplicity of dimples formed in its surface. It is assumed that the ball has a phantom sphere and spherical surface when the ball surface is free of dimples. A tangent angle θ is 5°≦θ≦20° wherein θ is defined between a tangent at an arbitrary point on an edge of an individual dimple to the phantom spherical surface and a tangent at that point to the actual ball surface. A percent dimple volume Vr is 0.8%≦Vr≦1.1% wherein Vr is the sum of the volumes of the entire dimples divided by the volume of the phantom sphere. This dimple design prevents lowering of spin susceptibility by repetitive hits without detracting from the dimple effect of increasing flight distance.

10 Claims, 2 Drawing Sheets

GOLF BALL

BACKGROUND OF THE INVENTION

1. Field of the Invention

This invention relates to a golf ball which is durable against repetitive hits.

2. Prior Art

From the past, it has been desired to improve the aerodynamics of golf balls. Various attempts have been made to increase the flight distance of golf balls, for example, by optimizing the shape and size of dimples to reduce a coefficient of drag and increase a coefficient of lift of the ball in flight.

Golf balls are generally classified into two-piece golf balls and wound golf balls. In the recent years, two-piece golf balls have become more popular partly because they follow a relatively straight trajectory and cover a longer distance as compared with wound golf balls. In fact, the market share of two-piece golf balls is outstandingly increasing.

Wound golf balls have the advantages of better hitting feel and control than two-piece golf balls. For example, wound golf balls using balata rubber as a cover stock are susceptible to spin in approach shots so that the balls can be stopped on the green as desired.

Ionomer resins are used as a base of the cover of two-piece golf balls and some wound golf balls. A golf ball using ionomer resin in the cover has a higher hardness than a wound balata ball. As compared with the wound golf ball, this golf ball receives a less spin rate upon approach shots so that it may be rather difficult to stop the ball on the green. Then, for the purpose of increasing a spin rate upon approach shots, several attempts have been made to improve the cover by tailoring the ionomer resin. None of ionomer resin covers proposed thus far are comparable to the balata rubber cover.

Another means for improving spin is to improve the club. For example, it has been proposed to increase a spin rate by improving the shape of furrows in the face of a short iron. When a ball is hit with such an improved short iron, despite an increased spin rate, there arises a problem that the dimples on the ball surface are collapsed, deformed or damaged by the club. The ball will shortly lose spin susceptibility as the ball is repeatedly hit.

The inventors carried out a fixed point hitting test on a commercially available two-piece golf ball A having a low hardness ionomer resin cover, a commercially available two-piece golf ball B having a high hardness ionomer resin cover, and a dimple-free ball C having a high hardness ionomer resin cover. The test used a sand wedge having a loft angle of 57°, the ball was hit 10 times at the same point at a head speed of 25 m/s, and a spin rate was measured on every hit. The dimple-free ball C showed little lowering of spin rate whereas dimpled balls A and B experienced a substantial lowering of spin rate after repeated hits. It was thus acknowledged that the spin performance decline mainly by deterioration of the shape of the dimples.

Therefore, an object of the invention is to provide a novel and improved golf ball wherein the configuration of dimples is improved to prevent the spin performance from lowering by repetitive hits without detracting from the dimples' own effect of increasing flight distance, that is, having improved flight performance stability and durability.

SUMMARY OF THE INVENTION

The present invention provides a golf ball having a multiplicity of dimples of at least one type formed in its surface. It is assumed that the ball has a phantom sphere and spherical surface when the ball surface is free of dimples. According to the invention, the dimples are designed such that (1) a tangent angle $\theta$ is in the range of $5° \leqq \theta \leqq 20°$ and (2) a percent dimple volume Vr is in the range of $0.8\% \leqq Vr \leqq 1.1\%$. The angle $\theta$ is defined between a tangent at an arbitrary point on an edge of an individual dimple to the phantom spherical surface and a tangent at that point to the actual ball surface, and the percent dimple volume Vr is the sum of the volumes of the entire dimples divided by the volume of the phantom sphere. Then the ball is effective for preventing spin susceptibility from being lowering by repetitive hits without detracting from the dimples' own effect of increasing flight distance.

More particularly, by designing the shape of dimples so as to satisfy the above-defined tangent angle $\theta$ in the specific range, it becomes possible to effectively prevent failure of dimples by repetitive hits and to prevent deterioration of spin susceptibility by repetitive hits, especially to outstandingly improve spin stability upon approach shots with a short iron. By designing the shape of dimples to satisfy the above-defined percent dimple volume Vr, such an improvement in hitting durability is achieved without detracting from the dimples' own effect of reducing a coefficient of drag and increasing a coefficient of lift of the ball in flight for increasing flight distance.

The inventors further made studies on the conditions under which the dimples' own effect was more effectively exerted. They have found that when a golf ball having a core enclosed with an ionomer resin cover is provided with dimples of the above-defined design, the ball is improved in hitting durability. These advantages are insured by providing the ball with a surface hardness of 80 to 98 as measured by a JIS-C scale hardness meter.

According to the invention, there is provided a golf ball having a multiplicity of dimples of at least one type formed in its surface wherein a tangent angle $\theta$ is in the range of $5° \leqq \theta \leqq 20°$ wherein the angle $\theta$ is defined between a tangent at an arbitrary point on an edge of an individual dimple to a phantom spherical surface given on the assumption that the ball surface is free of dimples and a tangent at the same point to the actual ball surface, and a percent dimple volume Vr is in the range of $0.8\% \leqq Vr \leqq 1.1\%$ wherein the percent dimple volume Vr is the sum of the volumes of the entire dimples divided by the volume of a phantom sphere given on the assumption that the ball surface is free of dimples.

In one preferred embodiment, the golf ball is constructed by enclosing a core with a cover, and at least a surface layer of the cover is formed mainly of an ionomer resin. The golf ball should preferably have a surface hardness of 80 to 98 as measured by a JIS-C scale hardness meter.

BRIEF DESCRIPTION OF THE DRAWINGS

These and further features of the present invention will be apparent with reference to the following description and drawings, wherein.

DETAILED DESCRIPTION OF THE INVENTION

The invention provides a golf ball wherein the configuration and volume occupation of dimples are optimized in consideration of flight performance and hitting durability.

Figure 1:
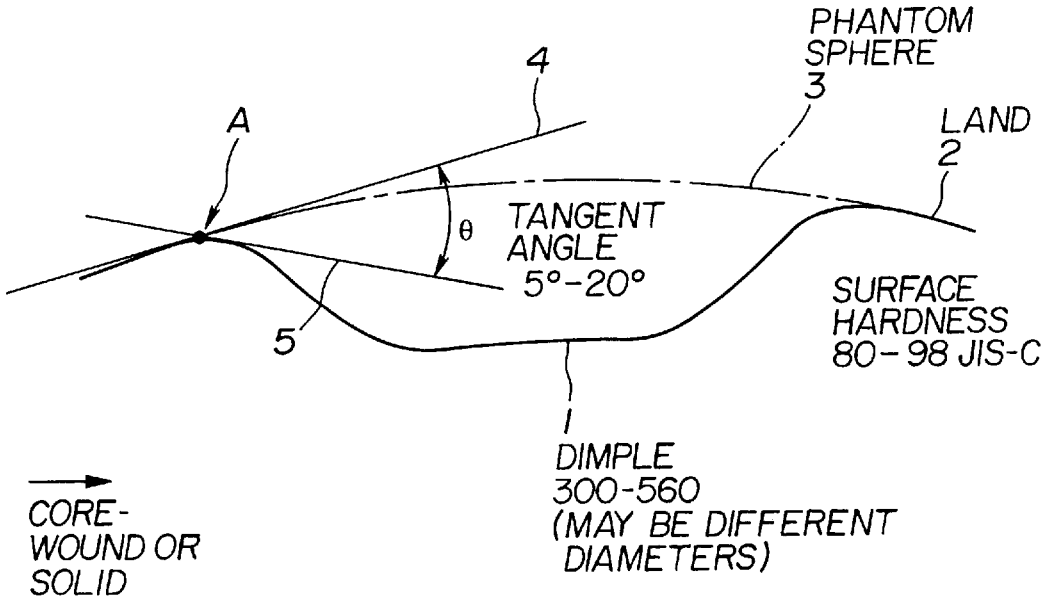
FIG. 1 is a schematic cross-sectional view of a dimple formed in a golf ball.

The configuration of dimples in the golf ball is optimized by properly adjusting the angle of a dimple edge relative to the spherical surface. Referring to FIG. 1, a dimple formed in a golf ball is schematically shown in radial cross section. The dimple 1 has a circular edge which is the boundary between the dimple 1 and a land 2. It is assumed that the ball has a phantom sphere and a phantom spherical surface 3 when the ball surface is free of dimples. It is understood that the land 2 is a continuation of the phantom spherical surface 3. A tangent angle θ is defined between a tangent 4 at an arbitrary point A on the dimple edge to the phantom spherical surface 3 and a tangent 5 at the point A to the actual dimple surface on the ball. The tangents are drawn from point A toward the inside of the dimple. According to the invention, the dimples are designed such that angle θ is in the range of $5° \leqq \theta \leqq 20°$, preferably $7° \leqq \theta \leqq 15°$. With an angle θ of less than 5°, the dimple has a volume insufficient to allow the dimple to exert its aerodynamic effect of increasing flight distance. With an angle θ of more than 20°, the dimple edge becomes sharp so that it may be damaged by repetitive hits, resulting in the spin performance being deteriorated.

In addition to the requirement of dimple edge tangent angle θ, the dimples are further designed to satisfy the requirement of a percent dimple volume Vr. The percent dimple volume Vr is defined as the sum of the volumes of the entire dimples divided by the volume of the phantom sphere 3. Briefly stated, the percent dimple volume Vr is a proportion of the total volume of dimples to the volume of the ball. According to the invention, Vr is in the range of $0.8\% \leqq Vr \leqq 1.1\%$, preferably $0.85\% \leqq Vr \leqq 1.0\%$. With $Vr < 0.8\%$, the effect of dimples increasing a coefficient of lift becomes excessive so that the flight distance is rather reduced upon driver shots. With $Vr > 1.1\%$, the effect of dimples increasing a coefficient of lift declines, resulting in a short flight distance.

The percent dimple volume Vr is calculated according to the formula:

$$Vr = \frac{Vs}{\frac{4}{3}\pi R^3} \times 100\%$$

wherein Vs is a sum of the volumes of dimple spaces each below a circular plane circumscribed by the dimple edge and the ball has a radius R.

Figure 2A:
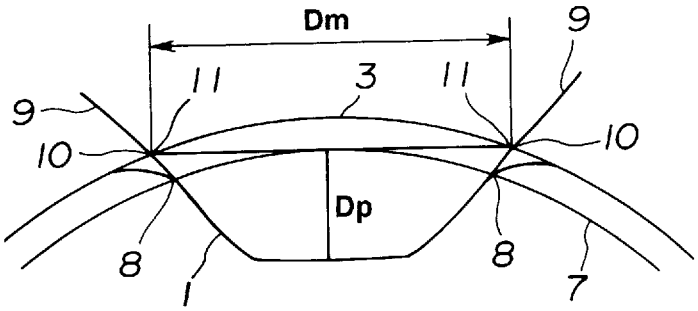
FIGS. 2(*a*) and 2(*b*) are schematic views illustrating how to calculate the volume of a dimple.
Figure 2B:
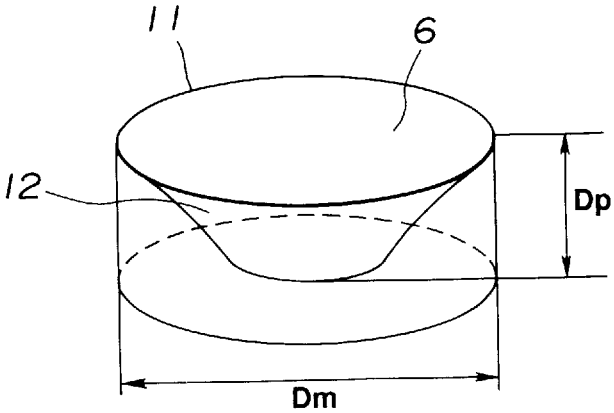

Referring to FIG. 2, it will be described how to calculate the volume of an individual dimple from which Vr is determined. It is assumed that the dimple has a circular plane shape. In conjunction with the dimple 1, as shown in FIG. 2(*a*), there are drawn a phantom spherical surface 3 having the ball diameter 2R and another phantom spherical surface 7 having a diameter smaller by 0.16 mm than the ball diameter. The other spherical surface 7 intersects with the dimple 1 at a point 8. A tangent 9 at intersection 8 intersects with the phantom spherical surface 3 at a point 10. A series of intersections 10 define a dimple edge 11.

As shown in FIG. 2(*b*), the dimple edge 11 circumscribes a circular plane 6 having a diameter Dm. Then the dimple 1 defines a space 12 located below the circular plane 6 and having a depth Dp. The volume Vp of the dimple space 12 is determined. The sum Vs of the volumes Vp of the entire dimples is given by the following expression. By substituting the thus obtained value of Vs in the Vr-calculating expression, the value of Vr is determined.

$$Vs = N_1Vp_1 + N_2Vp_2 + \ldots + N_nVp_n = \sum_{i=1}^{n} NiVpi$$

In the expression, $Vp_1$, $Vp_2$, . . . $Vp_n$ are the volumes of dimples of different size and $N_1$, $N_2$, . . . $N_n$ are the numbers of dimples having volumes $Vp_1$, $Vp_2$, . . . $Vp_n$, respectively.

The dimples formed in the golf ball of the invention are not particularly restricted with respect to shape, size, number of types, and overall number as long as they satisfy the values of θ and Vr. In most cases, the dimples preferably have a circular plane shape and a diameter of 2.4 to 4.1 mm, especially 2.5 to 3.5 mm. The number of dimple types is preferably 1 to 5. Especially, dimples of one or two types are formed in a ball. The overall number of dimples is preferably 300 to 560, especially 350 to 450.

As long as the golf ball of the invention has a multiplicity of the above-defined dimples in its surface, its structure is not particularly limited. The ball may be a wound golf ball having a thread wound core enclosed with a cover of one or more layers, a two or multi-piece solid golf ball having a solid core enclosed with a cover of one or more layers or a one-piece solid golf ball. The invention is advantageously applied to golf balls having a core enclosed with a cover, typically wound golf balls and two and multi-piece solid golf balls. The advantages of the invention become more outstanding when at least a surface layer of the cover is formed mainly of an ionomer resin. Suitable ionomer resins are commercially available, for example, under the trade name of "Surlyn" from E.I. dupont and "Himilan" from Mitsui duPont Polychemical K.K.

Also preferably, the golf ball of the invention has a surface hardness of 80 to 98, especially 88 to 95 as measured by a JIS-C scale hardness meter. The above-mentioned advantages of the dimples become more outstanding particularly when a golf ball of the type wherein a core is enclosed with a cover has a cover surface layer whose hardness falls within the above-defined range.

No particular limit is imposed on the wound core and the solid core. They may be formed from well-known stock materials by conventional methods. The diameter and weight of the ball may be properly determined according to the Rules of Golf prescribing a diameter of not less than 42.67 mm and a weight of not greater than 45.92 grams.

There has been described a golf ball wherein the configuration of dimples is improved so as to minimize lowering of the spin performance by repetitive hits without detracting from the aerodynamic effect of dimples. The ball is durable and remains stable with respect to aerodynamic performance.

EXAMPLE

Examples of the present invention are given below by way of illustration and not by way of limitation.

Examples 1–4 & Comparative Examples 1–3

A core-forming material of the composition shown in Table 1 was milled in a roll mill and heat compression molded at 155° C. for 15 minutes to form a solid core.

A cover stock of the composition shown in Table 1 was injection molded over the solid core to form a cover of 2 mm thick while dimples were indented at the same time as injection molding. In this way, there were obtained two-piece golf balls having a diameter of 42.7 mm and dimples as shown in Table 2. All the golf balls had 392 dimples of one type arranged in the same pattern.

The two-piece golf balls were examined for flight distance, spin rate, spin rate retention, and durability by the following tests. The results are shown in Table 2.

Flight distance

Using a swing robot made by True Temper Co., the ball was hit with a driver at a head speed of 45 m/s. A total distance was measured.

Approach spin

Using the same swing robot as above, the ball was hit with a sand wedge having a loft angle of 57° at a head speed of 25 m/s to measure a spin rate. The spin rate at the first hit is designated approach spin 1. Under the same conditions, the ball was hit 8 times at the same position. The spin rate at the eighth hit is designated approach spin 2.

Retention

The percent retention of spin rate is calculated by dividing approach spin 2 by approach spin 1.

Durability

A reduction of spin rate after repetitive hits was used as a measure of durability. The ball is rated "O" (passed) when the spin rate is not reduced or the spin rate is reduced to such an extent as to give rise to no substantial problem to ball performance. The ball is rated "X" (rejected) when the spin rate is reduced to such an extent as to give rise to a substantial problem to ball performance.

TABLE 1

| Core composition | Parts by weight |
|---|---|
| Cis-1,4-polybutadiene rubber (BR01) | 100 |
| Zinc acrylate | 33.2 |
| Barium sulfate | 9.7 |
| Zinc oxide | 10 |
| Antioxidant | 0.2 |
| Dicumyl peroxide | 0.9 |

| Cover composition | E1 | E2 | E3 | E4 | CE1 | CE2 | CE3 |
|---|---|---|---|---|---|---|---|
| Himilan H1605 | 50 | 50 | 50 | 50 | 50 | 50 | 50 |
| Himilan H1706 | 30 | 30 | 50 | 50 | 30 | 50 | 50 |
| Himilan H1557 | 20 | 20 | — | — | 20 | — | — |
| Cover hardness (JIS-C) | 88 | 88 | 95 | 95 | 88 | 95 | 95 |

TABLE 2

| | | E1 | E2 | E3 | E4 | CE1 | CE2 | CE3 |
|---|---|---|---|---|---|---|---|---|
| Design parameters | Surface hardness (JIS-C) | 88 | 88 | 95 | 95 | 88 | 95 | 95 |
| | Tangent angle θ (°) | 10 | 15 | 10 | 15 | 40 | 40 | 10 |
| | Dimple volume ratio Vr (%) | 0.85 | 0.85 | 0.9 | 0.85 | 0.85 | 0.85 | 0.6 |
| Performance | Flight distance (m) | 227 | 226 | 225 | 226 | 225 | 226 | 221 |
| | Approach spin 1 | 8320 | 8410 | 6860 | 6930 | 8470 | 7080 | 6740 |
| | Approach spin 2 | 8150 | 8060 | 6190 | 6170 | 4580 | 3900 | 5730 |
| | Retention (%) | 98 | 96 | 90 | 89 | 54 | 55 | 85 |
| | Durability | ○ | ○ | ○ | ○ | X | X | ○ |

As is evident from Table 2, golf balls within the scope of the invention have satisfactory flight performance and are fully durable against repetitive hits since they experience little drop of spin susceptibility after repetitive hits. In contrast, golf balls having a greater dimple edge tangent angle θ (Comparative Examples 1 and 2) experience a substantial drop of spin susceptibility after repetitive hits. A golf ball having a dimple edge tangent angle θ within the range of the invention, but a too low dimple volume ratio Vr outside the range of the invention (Comparative Example 3) is durable against repetitive hits, but poor in flight performance.

Although some preferred embodiments have been described, many modifications and variations may be made thereto in the light of the above teachings. It is therefore to be understood that within the scope of the appended claims, the invention may be practiced otherwise than as specifically described.

We claim:

1. A golf ball having a multiplicity of dimples of at least one type formed in its surface wherein;

a tangent angle θ is in the range of $5° \leqq \theta \leqq 20°$, wherein θ is defined between a first tangent extending from an arbitrary point on an edge of an individual dimple to a phantom spherical surface on the ball surface free of dimples and a second tangent at the same arbitrary point to the actual ball surface of the dimple, and a percent dimple volume Vr is in the range of $0.8\% \leqq Vr \leqq 1.1\%$ wherein, Vr is a sum of the volumes of the entire dimples divided by the volume of a phantom sphere of the ball surface free of dimples.

2. The golf ball of claim 1 comprising a core and a cover enclosing the core, at least a surface layer of the cover being formed mainly of an ionomer resin.

3. The golf ball of claim 2 having a surface hardness of 80 to 98 as measured by a JIS-C scale hardness meter.

4. The golf ball of claim 3, wherein said golf ball has a surface hardness in the range of 88 to 95 measured on the JIS-C scale.

5. The golf ball of claim 2, wherein said core is solid.

6. The golf ball of claim 2, wherein said core is thread wound.

7. The golf ball of claim 1, wherein $7° \leqq \theta \leqq 15°$.

8. The golf ball of claim 1, wherein $0.85 \leqq Vr \leqq 1.0\%$.

9. The golf ball of claim 1, wherein said golf ball has 350° to 450° dimples.

10. The golf ball of claim 1, wherein said dimples comprise dimples with at least two different diameters.

* * * * *

UNITED STATES PATENT AND TRADEMARK OFFICE

CERTIFICATE OF CORRECTION

PATENT NO. : 5,857,924
APPLICATION NO. : 08/840758
DATED : January 12, 1999
INVENTOR(S) : Naoyuki Miyagawa et al.

It is certified that error appears in the above-identified patent and that said Letters Patent is hereby corrected as shown below:

Col. 6, Line 9, claim 9 should read

-- 9. The golf ball of claim 1, wherein said golf ball has 350[[°]] to 450[[°]] dimples. --

Signed and Sealed this
Twenty-first Day of June, 2011

David J. Kappos

David J. Kappos
*Director of the United States Patent and Trademark Office*